United States Patent [19]

Takahashi et al.

[11] Patent Number: 4,893,484

[45] Date of Patent: Jan. 16, 1990

[54] WASHING MACHINE

[75] Inventors: Toshihiro Takahashi; Hideyuki Tobita; Koichi Ito; Shigeharu Nakano, all of Hitachi, Japan

[73] Assignee: Hitachi, Ltd., Tokyo, Japan

[21] Appl. No.: 254,230

[22] Filed: Oct. 6, 1988

[30] Foreign Application Priority Data

Oct. 12, 1987 [JP] Japan ..... 62-254538

[51] Int. Cl.[4] ..... D06F 33/02

[52] U.S. Cl. ..... 68/12 R

[58] Field of Search ..... 68/12 R

[56] References Cited

U.S. PATENT DOCUMENTS 4,743,820 5/1988 Veach ..... 68/12 R X

*Primary Examiner*—Philip R. Coe

*Attorney, Agent, or Firm*—Antonelli, Terry & Wands

[57] ABSTRACT

By using a relay of which contact is opened or closed in response to a signal from instruction and control unit, an electric power is supplied to a load unit through the contact of the relay. The relay is such that a power switch is turned on to excite a coil for closing the contact thereof. When a reserved operation is performed, the relay is turned off in response to the signal from the instruction and control unit at the time at which a reserved time and the contents of the reserved operation have been set. When the time to start the reserved operation comes, the relay is turned on again in response to the signal from the instruction and control unit to start a supply of electric power to the load unit. Power is not applied to the load unit during the waiting period until the reserved operation starts. Thus, the malfunction of the load unit due to the deterioration of the semiconductor switching elements is prevented, and a safer washing machine can be obtained.

6 Claims, 5 Drawing Sheets

| WASH | | RINSE (1st TIME) | | | | | RINSE (2nd TIME) | | | | | FINAL SPIN | | | TOTAL |
|---|---|---|---|---|---|---|---|---|---|---|---|---|---|---|---|
| WATER SUPPLY | STIR | WATER DISCHARGE | SPIN | PAUSE | WATER SUPPLY | STIR | WATER DISCHARGE | SPIN | PAUSE | WATER SUPPLY | STIR | WATER DISCHARGE | SPIN | PAUSE | |
| MIN. 2 | MIN. 10 | MIN. 1 | MIN. 2 | MIN. 0.5 | MIN. 2 | MIN. 1.5 | MIN. 1 | MIN. 2 | MIN. 0.5 | MIN. 2 | MIN. 1.5 | MIN. 1 | MIN. 4.5 | MIN. 0.5 | MIN. 32 |

WASHING MACHINE

BACKGROUND OF THE INVENTION:

The present invention relates to a washing machine, and more particularly to an electronically-controlled washing machine with a reservation function capable of reserving in advance a time at which a washing operation terminates.

A conventional electronically-controlled washing machine is disclosed, in for example Automation Technology (No. 12, Vol. 6, 1980) wherein when washing starts, a power switch is turned on to supply an electric power to a control unit and a load unit such as an agitating means, a water supply means, a water discharge means, a clutch change-over means, a softening and finishing agent charge means or the like. In the conventional washing machine, the supply of the electric power is continued even when a washing operation terminates unless the power switch is turned off by an operator.

In particular, washing machines with a reservation function are generally kept connected to a commercial power supply. With such a washing machine, even if a power switch is turned off, the commercial power supply is kept applied to the control unit although it seems that the commercial power supply has been completely cut off because an indicator lamp has gone off, a key input is prohibited from being acquired and an output for driving a load is prohibited.

In particular, it is typical that the commercial power supply is applied to the load unit and a power of 5–10 V is supplied to the control unit during a waiting period from the time a reserved operation is set to the time at which the operation actually starts.

The above stated conventional washing machine has disadvantages such as those shown below because the commercial power supply is applied to the load unit during a time at which the washing machine is not actually operated.

1. A malfunction of the load unit due to the deterioration of semiconductor switching elements such as TRIACs or the like which serve as switches to drive and to stop the load in response to a signal from an instruction and control unit, the semiconductor switching elements deteriorating in accordance with an application being supplied with electric power for a long time.

2. An unexpected abnormal operation of the washing machine which occurs when external noise reaches the instruction and control unit by passing through the commercial power supply and the atmosphere. This causes the instruction and control unit to malfunction or to get out of control.

3. An abnormal operation of the washing machine or an electric shock due to leakage of the semiconductor switching elements and the load unit caused by water attached thereto or the corrosion or the deterioration thereof.

As described above, in the conventional washing machine there is a lack of attention to safety when washing machines are used.

SUMMARY OF THE INVENTION

An object of the present invention is to provide a safer washing machine.

Another object of the present invention is to provide to a washing machine wherein the possibility of abnormal operation can be reduced.

A further object of the present invention is to provide a washing machine wherein the possibility of accident due to electric shock can be reduced.

A still further object of the present invention is to provide a washing machine wherein a malfunction due to the deterioration of semiconductor switching elements in the washing machine can be prevented.

A further object of the present invention is to provide a washing machine wherein the possibility that a load unit such as an agitator will perform an unexpected abnormal operation can be reduced.

In accordance with the present invention, a washing machine comprises an instruction and control unit having a reservation function means for performing a washing operation such as washing, rinsing, spinning or the like in an order set in advance and automatically performing the washing operation at a time set in advance, a drive for energizing a load unit such as a motor for an agitating means, a water supply valve, a water discharge valve or the like in accordance with an instruction from the instruction and control unit, and an automatic turning off power switch for connecting an alternating current power supply to the load unit and the drive unit.

A contact of a relay is interposed between the load unit and drive the automatic turning off power switch, whereby the contact of the relay is kept open during a waiting period until a reserved washing operation starts and the contact of the relay is closed in accordance with an instruction from the instruction and control unit when a time to start the reserved operation comes.

An instruction is applied to the drive unit for energizing the load unit by the instruction and control unit after the closing of the contact of the relay.

The automatic turning off power switch is turned off in accordance with an instruction from the instruction and control unit when the washing operation terminates and the contact of the relay is opened after the turning off of the automatic turning off power switch.

A power supply circuit is provided for converting an alternating current to a direct current, whereby the direct current is supplied to the instruction and control unit from the power supply circuit and a coil of the relay is supplied with the direct current in accordance with an instruction from the instruction and control unit.

By using the relay having a contact which is opened or closed in response to the signal from the instruction and control unit, the commercial electric power is supplied to the load unit through the contact of the relay.

The relay is such that the power switch is turned on to excite a coil for closing the contact thereof. With the arrangement, the commercial electric power is supplied to the load unit.

When a reserved operation is performed, the relay is turned off in response to the signal from the instruction and control unit at the time at which a reserved time and the contents of the reserved operation have been set.

When the time to start the reserved operation comes, the relay is turned on again in response to the signal from the instruction and control unit to start a supply of the commercial electric power to the load unit, and the operation of the washing machine is performed.

With the operation, the commercial electric power is not supplied to the load unit during the reservation waiting period from a time at which the reserved operation is set to a time at which the operation starts. Thus the deterioration of the semiconductor switching elements due to the application of a voltage and the dangers such as abnormal operation of washing machine, the electric shock or the like can be prevented.

According to the present invention, a commercial power is not applied to the load unit of the washing machine during the waiting period until the reserved operation starts. Thus, the malfunction of the load unit due to the deterioration of the semiconductor switching elements can be prevented and a safer washing machine can be obtained.

Even if the instruction and control unit malfunctions or runs out of control due to external noise reaching the instruction and control unit after passing through the commercial power supply or the atmosphere, there is no possibility that the load unit will perform an unexpected abnormal operation. Thus, a safer washing machine can be obtained.

Even if the leakage or the like occurs in the semiconductor switching elements or the load unit, a possibility that the washing machine will operate abnormally or of an accident such as an electric shock can be reduced, and a safer washing machine can be obtained.

DESCRIPTION OF THE INVENTION

One embodiment of the present invention will be described below with reference to drawings.

Figure 2:
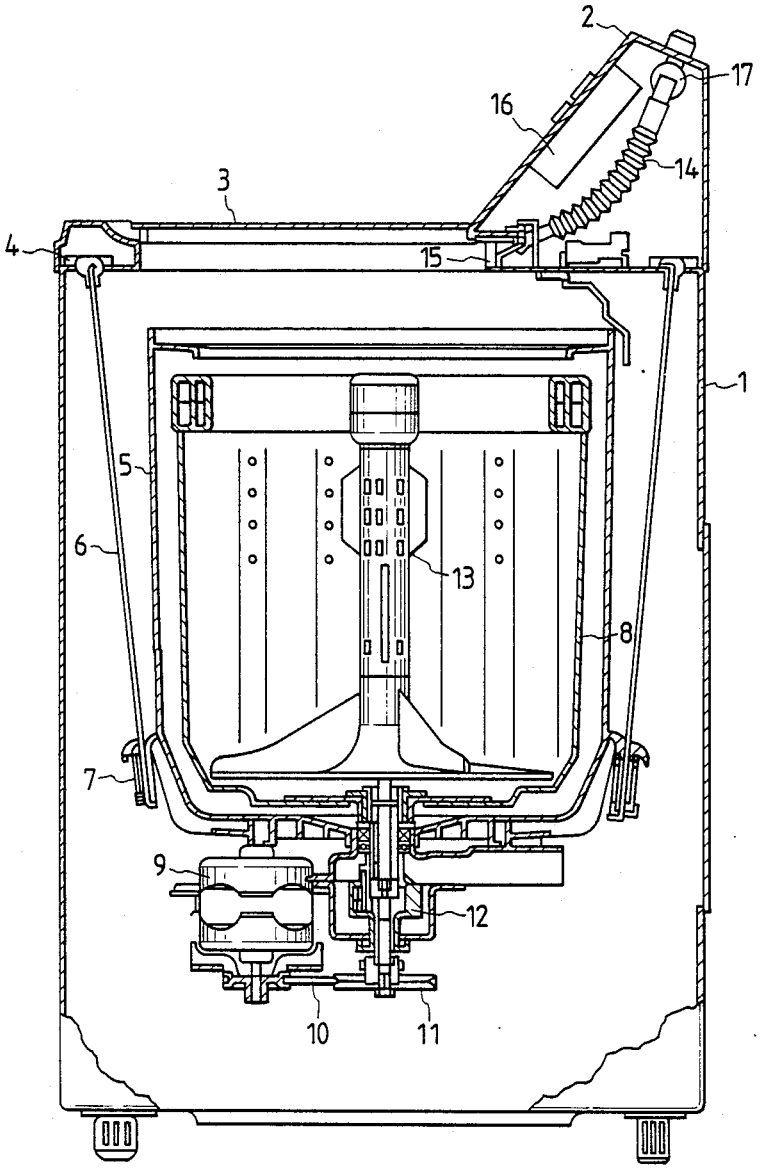
FIG. 2 is a cross-sectional view of a washing machine main body according to one embodiment of the present invention.

In FIG. 2, a washing machine main body includes an outer frame 1, a top cover 2 for covering the upper surface of the outer frame 1, an openable and closable lid 3 mounted on the top cover 2, and corner plates 4. The corner plates 4 are fixed to the upper four corners of the outer frame 1 to support a water receiving tub 5 at four positions by means of suspension rods 6. Vibration proofing springs 7 mounted on the suspension rods 6 absorb vibration of the water receiving tub 5 during spinning.

A basket 8 rotates at a high speed during the spinning for centrifugally spinning the washing. The power of a motor 9 is transmitted to a speed reduction unit 12 through a belt 10 and a pulley 11 for speed reduction and drives an agitator 13 at a low rotational speed.

The washing machine main body includes further a water supply hose 14, a water supplying port 15 for supply water from a tap into the water receiving tub 5 and an electronic timer 16. The electronic timer 16 is used to instruct and control the operation of the drive motor 9, and a water supply valve 17 or the like. The drive motor 9 rotates in both forward and reverse directions to permit the agitator 13 to rotate forward and reverse repeatedly.

Figure 1:
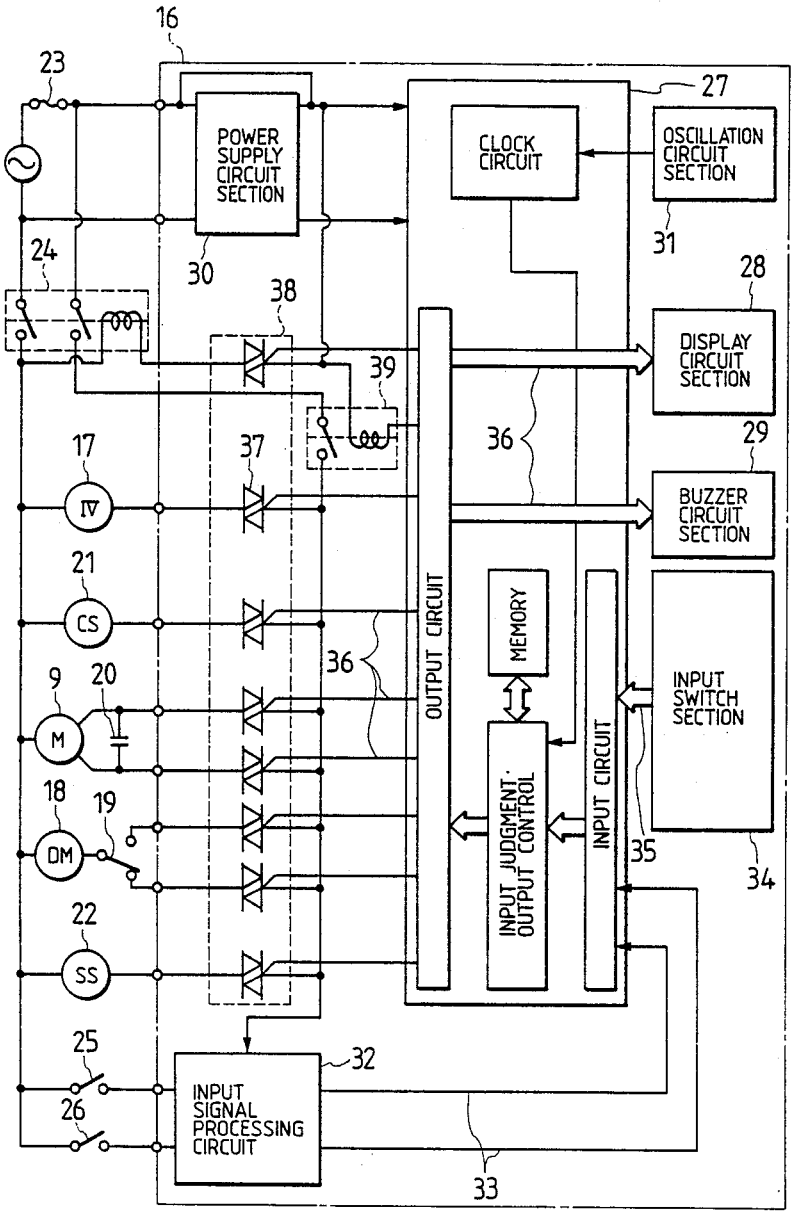
FIG. 1 is a diagram of an electric circuit of a washing machine according to one embodiment of the present invention.

In FIG. 1, the electric circuit of the washing machine includes a motor 18 for actuating the water discharge valve 17, a water discharge valve status switch 19 for designating the water discharge valve 17 to an open state or to a closed state, a capacitor 20 for advancing phases for the actuating motor 18, a clutch solenoid 21 for actuating a clutch speed reduction unit, and a solenoid 22 for charging a softening and finishing agent for softly finishing the washing.

The electric circuit of the washing machine includes further a current fuse 23 disposed on a power line, a power switch 24, a pressure switch 25 for sensing a water level in the water receiving tub 5, and a safety switch 26 for sensing the opening and closing of the lid 3 and the strong vibration of the basket 8 during a spinning operation.

An instruction and control unit 27 includes respective units and circuits illustrated in FIG. 2. The instruction and control unit 27 comprises an LSI element having a calculation function such as a microcomputer.

The electric circuit of the washing machine includes further a display circuit section 28 comprising light emitting diodes, a buzzer circuit section 29 for producing various kinds of warning sounds, and a power supply circuit section 30. The power supply circuit section 30 converts an alternating current (AC) into a direct current (DC) and changes a high voltage (AC 100 V) to a low voltage (DC 5.5 V) to make a power supply for the electronic timer 16.

An oscillation circuit section 31 supplies a clock to the instruction and control unit 27. An input signal processing circuit 32 applies signals from the pressure switch 25 and the safety switch 26 to the instruction and control unit 27 through input signal bus lines 33. An input switch 34 applies a state of an input switch to the instruction and control unit 27 likewise through a signal bus line 35.

An output signal bus lines 36 apply signals from the instruction and control unit 27 to the display circuit section 28, the buzzer circuit section 29 and a drive unit 38 comprising switching elements such as TRIACs 37 or the like.

A relay 39 is included is turned on and off in response to a signal from the instruction and control unit 27. Closing a contact of the relay 39 causes AC power of 100 V to be supplied to the water supply valve 17, the clutch solenoid 21, the driver motor 9, the actuating motor 18 for actuating the water discharge valve 17, the solenoid 22 for charging a softening and finishing agent, the pressure switch 25, and the safety switch 26.

With the above stated arrangement, when the power switch 24 is turned on during a normal washing operation, the relay 39 is in an ON state and an input for instructing an operation is applied to the input switch unit 34, a signal from the pressure switch 25 is discriminated. When water is not fully supplied into the water receiving tub 5, a signal is issued from an output circuit of the instruction and control unit 27 so that a switch processing is effected in the driving circuit 38 through the output signal bus lines 36 for turning on the water supply valve 17.

With the operation, water is supplied from the water supply port 15 through the water supply hose 14. When the water is fully supplied into the water receiving tub 5, the signal from the pressure switch 25 is switched to cut off the power supply to the water supply valve 17 so that a washing process starts.

During the washing process, the agitator 13 is operated in a short cycle composed of a clockwise rotation, a pause, a counter-clockwise rotation and a pause to apply a mechanical force to the washing. Although a washing time of up to approximately 10 (ten) minutes can be set, it can be set to a shorter time depending on a degree of dirtiness.

Figure 3:
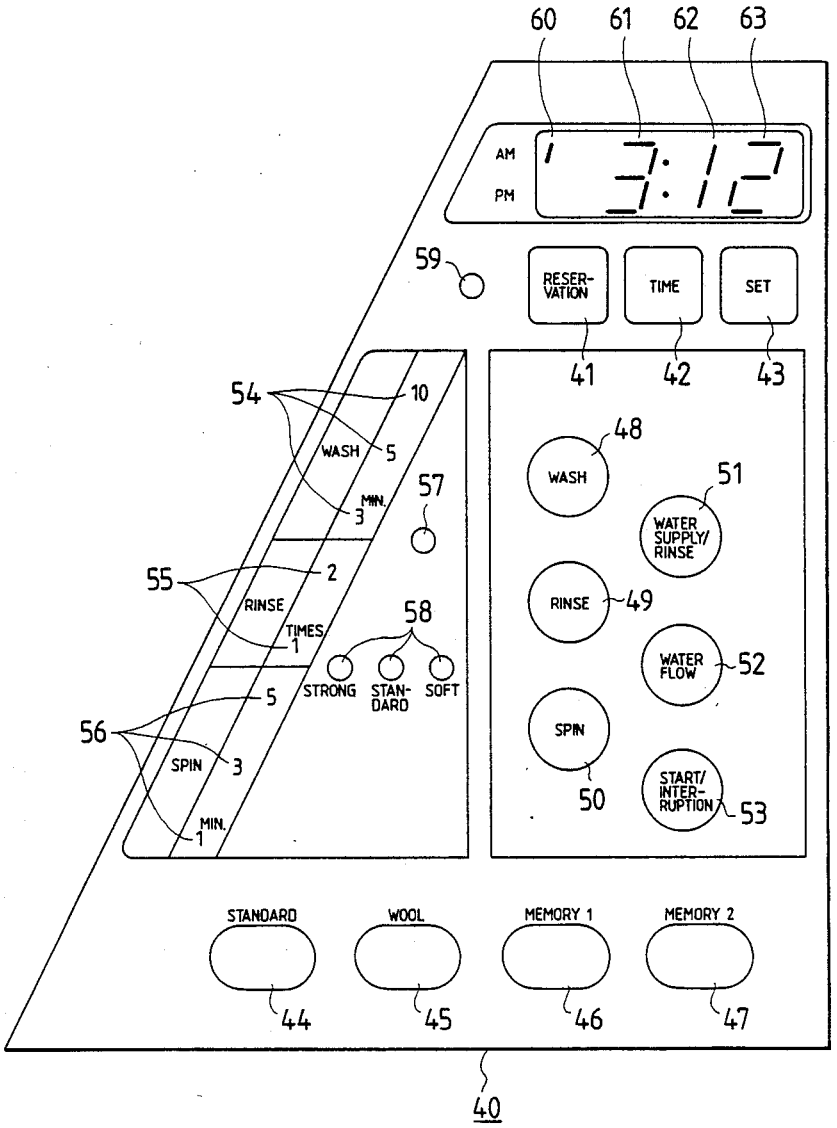
FIG. 3 is a diagram of an input display board of the washing machine.

Next, input keys and an input display board 40 having light emitting diodes for display both disposed on the top cover 3 will be described with reference to FIGS. 3 and 4.

The input display board 40 is provided with 13 (thirteen) input keys, 13 (thirteen) progress display light emitting diodes and a 4-digit segment light emitting diode.

To describe them in more details, the input keys are composed of 3 (three) keys (a reservation key 41, a time key 42, a set key 43) used for setting a present time and a time at which a reserved operation terminates.

The input keys are composed of 4 (four) keys (a standard cycle key 44, a wool cycle key 45, a memory 1 cycle key 46, a memory 2 cycle key 47) for a full automatic cycle, wherein depressing only a single key sets an operation sequence composed of a combination of washing, rinsing and spinning which have been set in advance and an operation starts as soon as the operation sequence is set.

The input keys are composed of 6 (six) manual setting keys (a washing key 48, a rinsing key 49, a spinning key 49, a water supply and rinsing key 51, a water flow key 52, a start/interruption key 53) for individually instructing washing time and spinning time, the number of rinsings, a rinsing method, a degree of a water flow and a start and a stop of an operation.

The progress display light emitting diodes comprise 3 (three) wash display LEDs 54, 2 (two) rinsing display LEDs 55, 3 (three) spinning display LEDs 56, a water supply and rinsing display LED 57, 3 (three) water flow display LEDs 58, and a reserved operation display LED 59.

A 7-segment light emitting diode comprises an AM/PM display section 60, an hour display section 61, a 10-minute display section 62, and a 1-minute display section 63.

Figure 4:
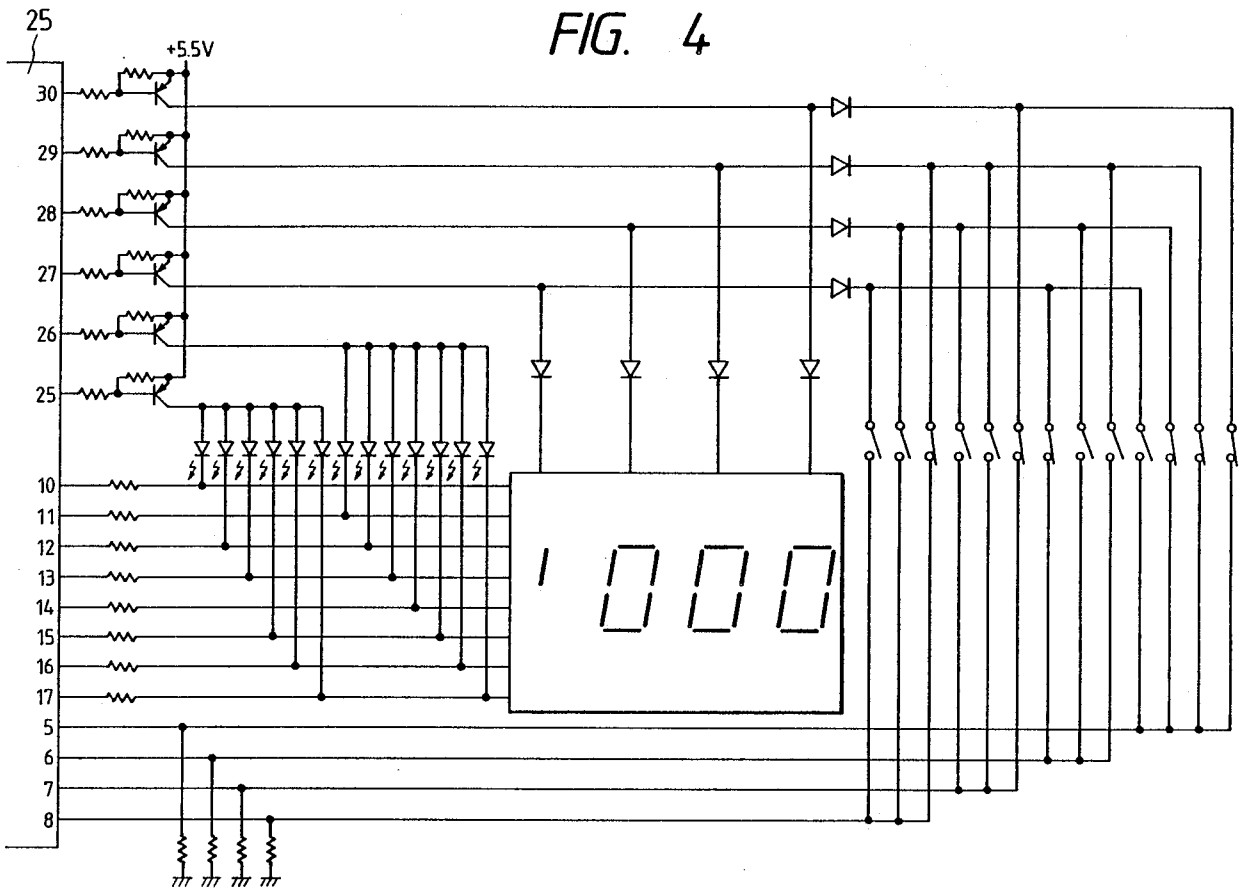
FIG. 4 is a detailed circuit diagram of a display circuit section and an input switch unit of the washing machine.
Figures 5, 6:
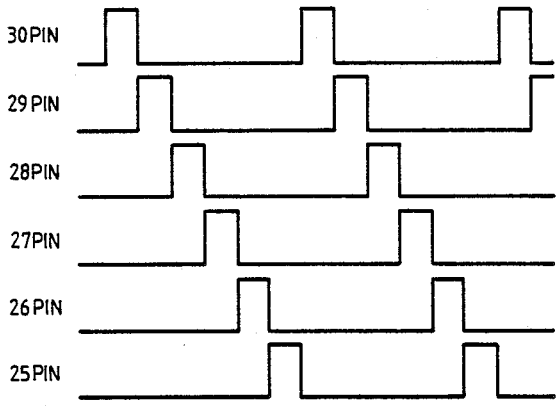
FIG. 5 is a diagram of a wave-form of a voltage supplied to the display circuit section and the input switch unit of the washing machine.
FIG. 6 is a time chart of the operation of the washing machine.

FIG. 4 is an electric circuit diagram illustrative of the display circuit section 28 and the input switch unit 34 in details. The display circuit section 28 comprises a matrix of 6×8 and the input switch unit comprises a matrix of 4×4. As shown in FIG. 5, the instruction and control unit 27 has No. 25 pin to No. 30 pin where pulse signals with 6 shifted (six) phases are produced at all times.

Next, methods of setting a present time and a time at which a reserved operation terminates will be described. When a washing machine is connected to a power supply of AC 100 V and the power switch 24 (automatic turning off switch) is manually depressed to be turned on, a display of '[illegible] appears on the 7-segment light emitting diode in the display circuit section 28.

The symbol ' at the head of an AM/PM display section 60 goes on and off to indicate that the present time is not yet set. When the present time has been set, turning on the power switch 24 causes the 7-segment light emitting diode to display the present time.

When the present time is newly set or is reset, the time key 42 is depressed with the 7-segment light emitting diode flashing. With this operation, setting can be changed as '→, '→(AM→PM→AM). When it is determined which of AM or PM is to be set, the set key 43 is depressed to shift the flashing portion to an adjacent time display section 61.

When the time key 42 is depressed again, the setting can be changed as [illegible]. . . every time the time key 42 is depressed. When the setting is determined, depressing the set key 43 shifts the flashing portion to an adjacent 10-minute display section 62.

Likewise, when the 10-minute display section 62 and an 1-minute display section 63 have been set and the set key 43 is depressed for setting the 1-minute display section 63, the buzzer circuit section 29 keeps a long notifying sound for notifying that the present time has been set and at the same time a clock function starts.

Next, a method of setting a time at which a reserved operation terminates will be described. The time at which the reserved operation terminates is set by depressing the reservation key 41 with the present time set. When a reserved operation was performed before, a time at which the previous reserved operation terminated is displayed. Otherwise, the 7-segment light emitting diode displays '[illegible].

When a time at which reserved operation terminates is to be changed, depressing the set key 43 causes the AM/PM display section 60 at the head to begin to go on and out, whereby the set time can be changed. A time at which a reserved operation terminates can be set by the same procedure as the one used for setting a present time hereafter.

Next, the operation of the washing machine performed by reservation will be described. First, the power switch 24 (automatic turning off switch) is turned on by manual depression. The 7-segment light emitting diode in the display circuit section 28 displays a present time and an LED for displaying a standard water flow of the LEDs for displaying a water flow lights.

At the same time, a coil of the relay 39 is excited in response to a signal from the instruction and control unit 27 to cause the contact of the relay 39 to close so that the load unit such as the drive motor 9, the water supply valve 17 and the like are energized. The sequence of the reserved operation is set in the condition that a present time and a time at which the reserved operation terminates are set by the above stated method.

When the operation is performed in a full automatic cycle, an operation with a designated sequence is reserved by depressing one of the standard cycle key 44, the wool cycle key 45, the memory 1 cycle key 46, and the memory 2 cycle key 47.

When an operation is to be set manually, the operation with a desired sequence is set by depressing necessary keys out of the washing key 48, the rinsing key 49, the spinning key 50, the watering supply and rinsing key 51 and the water flow key 52 a required number of times. When the sequence of the operation is determined, the reservation is completed by lastly depressing the start/interruption key 53.

When the setting of the reservation is completed, the buzzer circuit section 29 issues a long notifying sound for notifying that the reservation has been completed in either case of the full automatic cycle and the manual setting.

At the same time, the relay 39 is turned off in response to a signal from the instruction and control unit 27 so that the load unit such as the drive motor 9, the water supply valve 17 and the like are deenergized.

The progress display light emitting diode displays the sequence of the operation set for 6 (six) seconds after the reservation has been completed and then it goes out. However, only the reserved operation display LED 59 indicating that the reserved operation is set stays lit. Thus, the washing machine is in a state of waiting for the reserved operation to start.

The 7-segment light emitting diode displays a time at which the reserved operation terminates while the washing machine waits for the reserved operation. The reserved operation starts when a time elapses and a time arrives which coincides with the time at which the reserved operation terminates minus a necessary operation time.

At first, the relay 39 in an OFF state is turned on in response to the signal from the instruction and control unit 27, whereby the load unit which has been deenergized are energized again. The progress display light emitting diode section displays the sequence of the operation set in advance 2 (two) seconds after the relay 39 is turned on.

At the same time, the 7-segment light emitting diode section ceases to display the time at which the reserved operation terminates and begins to display a remaining time of the necessary operation time set.

The reserved operation is performed according to a set sequence of the operation in the manner described above and the operation terminates at the time the reserved operation terminates and the washing machine returns to an initial state.

When a next operation is not performed continuously after the completion of the operation and the washing machine is left as it is, a solenoid in the power switch 24 is excited in response to a signal from the instruction and control unit 27 to turn off the power switch 24, whereby energizing of the load unit and lighting of the light emitting diodes in the display circuit section 28 are interrupted.

However, the power circuit for supplying weak electric power (DC 5.5 V) operates even if the power switch 24 is turned off so that the power is continuously supplied to the instruction and control unit 27, whereby a clock function operates continuously and various kinds of information stored in the instruction and control unit 27 such as the time at which the previously reserved operation terminates, the sequence of the operation set in the memory 1 cycle and the memory 2 cycle or the like are retained.

A necessary operation time required for determining an operation start time based on a time at which a reserved operation terminates is calculated in the instruction and control unit 27 using a time chart shown in FIG. 6.

The necessary operation time is calculated assuming at first that a water supplying time is 2 (two) minutes and a water discharging time is 1 (one) minute. A agitating time for washing includes 10 (ten) minutes, 5 (five) minutes and 3 (three) minutes, respectively depending on a set sequence. A final spinning time includes 5 (five) minutes, 3 (three) minutes and 1 (one) minute.

A necessary total time varies with a menu of operation selected; a operation without a washing process, without a second rinsing process, without first and second rinsing processes, without a final spinning process or the like.

As described above, according to the embodiment of the present invention, since AC 100 V power is not supplied to the load unit during a reservation waiting period from the setting of a reserved operation to the start of the operation, the load unit is not in an operating condition even if the semiconductor switching elements such as the TRIACs 37 or the like fails and they are in a short-circuit condition.

Further, even if an external noise passing through an AC 100 V line or the atmosphere reaches the instruction and control unit 27 and an abnormal signal is issued from the instruction and control unit 27 because it malfunctions or runs out of control, there is no possibility that the load unit operate unexpectedly.

Furthermore, since a rate of failure and deterioration of semiconductor switching elements increases in proportion to a period of time during which a voltage is applied to them, the embodiment of the present invention can reduce the deterioration and failure of the semiconductor switching elements.

Incidentally, with reference to a relation between a timing of the closing of the contact of the relay 39 and a timing of the turning on of the drive unit 38, an arrangement is such that the instruction and control unit 27 turns on the drive unit 38 after the contact of the relay 39 is closed.

The reason why the turning on of the former is delayed is to prevent the contact of the relay 39 from directly supplying a load current to the drive motor 9 or the like.

In addition, the turning off of the automatic turning off power switch 24 opens the contact of the relay 39. The reason why the opening of the contact of the relay 39 is delayed is to cause the automatic turning off switch 24 to cut off a load current in advance when there is the load current in unexpected circumstances.

Because of the reason as described above, the load current is not supplied or not cut off by the contact of the relay 39 so that a current capacity of the contact of the relay 39 can be very small.

Since a current supplied to the coil of the relay 39 is connected to an output of the power supply circuit for producing a direct current, the relay 39 may be made smaller than a relay for an alternating current, which is suitable for actuating the contact of the relay 39 with the smaller current capacity.

By the way, the coil of the relay 39 is supplied with electric power of 24 V, 15 mA. This means that the instruction and control unit 27 has an output circuit providing a comparatively large power as an IC-based instruction and control unit 27 and hence it is difficult to provide a larger power. The relay 39 can be operated with such a small power.

We claim:

1. A washing machine comprising an instruction and control unit having a reservation function means for enabling performance of an at least one reserved washing operation in an order set in advance and at a time set in advance, a drive unit for energizing a load unit for an agitating means, a water supply valve, and a water discharge valve in accordance with an instruction from said instruction and control unit, and an automatic turning off power switch for connecting an alternating current power supply to said load unit and said drive unit, characterized in that a contact of a relay is interposed between said load unit and said drive unit and said automatic turning off power switch, whereby said contact of said relay is kept open during a waiting period until said at least one reserved washing operation is to be started and said contact of said relay is closed in accordance with an instruction from said instruction and control unit at a start time of said at least one reserved washing operation, said contact of said relay automatically opening after said at least one reserved washing operation has been set in advance.

2. A washing machine according to claim 1, characterized in that an instruction is applied to said drive unit for energizing said load unit by said instruction and control unit after the closing of said contact of said relay.

3. A washing machine according to claim 1, characterized in that said automatic turning off power switch is turned off in accordance with an instruction from said instruction and control unit when the reserved washing operation terminates, said contact of said relay being opened after the turning off of said automatic turning off power switch.

4. A washing machine according to claim 2 or 3, characterized in that a power supply circuit is provided for converting an alternating current to a direct current, whereby the direct current is supplied to said instruction and control unit from said power supply circuit and a coil of said relay is supplied with the direct current in accordance with an instruction from said instruction and control unit.

5. A washing machine according to claim 1, wherein said contact of said relay is maintained in a closed condition when said automatic turning off power switch is maintained in a closed condition.

6. A washing machine according to claim 1, wherein said reservation function means enables performance of a plurality of reserved washing operations in an order set in advance and at a plurality of times set in advance, said relay automatically opening after said plurality of reserved washing operations have been set.

* * * * *